US007231864B2

(12) United States Patent
Ratti

(10) Patent No.: US 7,231,864 B2
(45) Date of Patent: Jun. 19, 2007

(54) RECIPROCATING BARREL FIREARM APPARATUS

(76) Inventor: Andres Ratti, 100 Gloucester Street, #604, Toronto, Ontario (CA) M4Y 1M1

( * ) Notice: Subject to any disclaimer, the term of this patent is extended or adjusted under 35 U.S.C. 154(b) by 494 days.

(21) Appl. No.: 10/898,276

(22) Filed: Jul. 23, 2004

(65) Prior Publication Data

US 2006/0027091 A1 Feb. 9, 2006

(51) Int. Cl.
*F41A 5/16* (2006.01)

(52) U.S. Cl. ..... 89/161; 89/159; 42/10

(58) Field of Classification Search ..... 89/159–161; 42/10, 11

See application file for complete search history.

(56) References Cited

U.S. PATENT DOCUMENTS

| | | | | | |
|---|---|---|---|---|---|
| 877,657 | A | * | 1/1908 | Mason | 89/145 |
| 958,545 | A | * | 5/1910 | Ross | 89/138 |
| 2,211,405 | A | | 8/1940 | Browning | |
| 2,628,536 | A | * | 2/1953 | Schaich | 89/159 |
| 3,088,378 | A | * | 5/1963 | Boudreau | 89/161 |
| 3,365,828 | A | * | 1/1968 | Badali et al. | 42/105 |
| 3,736,839 | A | * | 6/1973 | Childers | 89/128 |
| 3,869,961 | A | | 3/1975 | Kawamura | |
| 4,028,994 | A | * | 6/1977 | Ferluga | 89/161 |
| 4,061,075 | A | * | 12/1977 | Smith | 89/132 |
| 4,151,782 | A | * | 5/1979 | Allen | 89/155 |
| 4,817,496 | A | | 4/1989 | Zedrosser | |
| 5,123,329 | A | * | 6/1992 | Irwin | 89/161 |
| 5,628,137 | A | | 5/1997 | Cortese | |
| 5,834,678 | A | | 11/1998 | Kalb | |
| 5,939,659 | A | * | 8/1999 | Dobbins | 89/161 |
| 6,405,631 | B1 | * | 6/2002 | Milek | 89/139 |

* cited by examiner

*Primary Examiner*—Michael J. Carone
*Assistant Examiner*—Bret Hayes

(57) ABSTRACT

A firearm apparatus includes a gun housing which includes a barrel support channel between a front gun housing portion and an intermediate gun housing portion. A reciprocating barrel is housed inside the gun housing and includes a piston-sleeve-contained barrel portion slidingly received in a piston sleeve which is housed in the front gun housing portion and in front of the barrel support channel. Proximal portions of a barrel piston head, the piston-sleeve-contained barrel portion, and the piston sleeve form a pressure space into which a portion of high pressure combustion gasses from a fired cartridge enter. The high pressure gasses propel the barrel forward until the barrel piston head reaches the end of the piston sleeve. Then, a recoil spring returns the barrel to its original position. As the barrel moves back and forth, a fresh cartridge is automatically loaded from a magazine into a barrel chamber portion, the cartridge is fired, and the spent cartridge is automatically discharged.

4 Claims, 17 Drawing Sheets

RECIPROCATING BARREL FIREARM APPARATUS

BACKGROUND OF THE INVENTION

1. Field of the Invention

The present invention relates generally to firearms and, more particularly, to firearms that have a relatively short length.

2. Description of the Prior Art

Firearms of various sizes and shapes are well known in the art. At times, the length of the firearm is of particular concern. A limiting factor for the length of a firearm is the length of the barrel. However, having a firearm whose length is no longer than the length of the barrel is virtually impossible. There are other important components of the firearm, besides the barrel, which add to the length of the firearm. However, it would be desirable if a firearm could be designed that has a length which is only minimally longer than the length of the barrel.

Throughout the years, a large number of innovations have been developed relating to firearms which employ released gasses from an ignited propellent to automatically or semi-automatically operate the loading or discharging of a cartridge, and the following U.S. patents are a small sample of some of those innovations: U.S. Pat. Nos. 2,211,405, 3,869,961, 4,817,496, 5,628,137, and 5,834,678.

Of special interest is U.S. Pat. No. 4,817,496 in which a firearm includes a gas drive for actuating loading and/or firing means in response to the discharge of a round, wherein the gas drive comprises a pneumatic cylinder and a pneumatic piston, the cylinder chamber communicates with the barrel bore through at least one transverse bore in the barrel, and powder gas is adapted to enter said cylinder chamber through said transverse bore and to move said cylinder and piston relative to each other against the force of a return spring. In order to provide a gas drive which is particularly simple and functionally reliable, light in weight and compact, the barrel is provided with a collar or the like, which constitutes a stationary pneumatic piston, and the pneumatic cylinder consists of a sliding sleeve, which surrounds the collar and is longitudinally displaceable between stops. With this patent, it is noted that the barrel remains stationary while an extraneous piston moves relative to a fixed cylinder. For purposes of simplicity of manufacture and operation, it would be desirable if a firearm were provided which employs a barrel that is moved by released gasses from an ignited propellent to automatically or semi-automatically operate the loading or discharging of a cartridge.

U.S. Pat. Nos. 2,211,405, 3,869,961, 5,628,137, and 5,834,678 are cited as being of interest for additional firearms that employ stationary barrels.

Another desirable feature in a reciprocating barrel firearm apparatus would be the ability to select either semi-automatic or full automatic operation.

Thus, while the foregoing body of prior art indicates it to be well known to use automatic firearms, the prior art described above does not teach or suggest a reciprocating barrel firearm apparatus which has the following combination of desirable features: (1) has a length which is only minimally longer than the length of the barrel; (2) employs a barrel that has reciprocating movement caused by released gasses from an ignited propellent to automatically or semi-automatically operate the loading or discharging of a cartridge; and (3) enables selection of either semi-automatic or full automatic operation. The foregoing desired characteristics are provided by the unique reciprocating barrel firearm apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a firearm apparatus which includes a gun housing which includes a front gun housing portion, a rear gun housing portion, and an intermediate gun housing portion located between the rear gun housing portion and the rear gun housing portion. The gun housing includes a barrel support channel between the front gun housing portion and the intermediate gun housing portion. A barrel is housed inside the gun housing. The barrel includes a piston-sleeve-contained barrel portion located substantially in the front gun housing portion, an intermediate barrel portion located substantially in the intermediate gun housing portion, and a barrel chamber portion located substantially in the rear gun housing portion. The piston-sleeve-contained barrel portion includes a barrel piston head and primary first gas ports located behind the barrel piston head. A piston sleeve is housed in the front gun housing portion and in front of the barrel support channel. The piston sleeve receives the piston-sleeve-contained barrel portion, and the barrel piston head is in sliding contact with the piston sleeve. Proximal portions of the barrel piston head, the piston-sleeve-contained barrel portion, and the piston sleeve form a pressure space.

A recoil spring retainer portion is connected to the intermediate barrel portion between the barrel support channel and the barrel chamber portion. A main recoil spring is located between the barrel support channel and the recoil spring retainer portion. A trigger/firing pin mechanism assembly is supported by the gun housing and extends through portions of the front gun housing portion, the intermediate gun housing portion, and the rear gun housing portion.

A cartridge ejection/loading assembly is supported by the rear gun housing portion, and a cartridge magazine assembly is supported by the rear gun housing portion and is in communication with the cartridge ejection/loading assembly.

In general, when the reciprocating barrel firearm apparatus of the invention is used, when the trigger/firing pin mechanism assembly is actuated, a cartridge in the barrel chamber portion is fired, and a bullet leaves the cartridge and passes through the intermediate barrel portion and the piston-sleeve-contained barrel portion. High pressure gasses follow the bullet as it proceeds through the barrel, and the high pressure gasses are contained by the barrel behind the bullet. When the high pressure gasses reach the piston-sleeve-contained barrel portion, some of the high pressure gasses exit from the piston-sleeve-contained barrel portion through the primary first gas ports into the pressure space, allowing pressure to build up in the pressure space. As pressure builds up in the pressure space, the pressure in the pressure space presses against the rear wall of the barrel piston head, causing the barrel piston head to push the barrel forward. As the barrel moves forward, the main recoil spring is compressed between the barrel support channel and the recoil spring retainer portion. When the rear wall of the barrel piston head reaches the end of the piston sleeve, the high pressure gasses in the pressure space are released into the atmosphere from the pressure space. Then, the compressed main recoil spring returns to it unstressed condition, and the cartridge ejection/loading assembly ejects the spent cartridge from the barrel chamber portion and loads a fresh cartridge into the barrel chamber portion.

The trigger/firing pin mechanism assembly can include a trigger member supported by the gun housing. A trigger-action bar is connected to the trigger member. A sear is connected to the trigger-action bar. A striker-actuation transfer bar is connected to the trigger-action bar. A striker operated by the sear, and a firing pin operated by the striker-actuation transfer bar.

The cartridge ejection/loading assembly can include an auxiliary gas port located in the piston-sleeve-contained barrel portion for passing high pressure gasses through the barrel to the pressure space. A barrel unlocker bar which includes a forward bar portion in the pressure space and an intermediate bar portion is connected to the forward bar portion. A lifting/locking member supported by the gun housing and in contact with the intermediate bar portion. The lifting/locking member is in contact with the barrel chamber portion. A loading/ejector lever is provided for removing a cartridge from the cartridge magazine assembly for loading the cartridge into the barrel chamber portion.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least four preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved reciprocating barrel firearm apparatus which has all of the advantages of the prior art and none of the disadvantages.

It is another object of the present invention to provide a new and improved reciprocating barrel firearm apparatus which may be easily and efficiently manufactured and marketed.

It is a further object of the present invention to provide a new and improved reciprocating barrel firearm apparatus which is of durable and reliable construction.

An even further object of the present invention is to provide a new and improved reciprocating barrel firearm apparatus which is susceptible of a low cost of manufacture with regard to both materials and labor, and which accordingly is then susceptible of low prices of sale to the consuming public, thereby making such reciprocating barrel firearm apparatus available to the buying public.

Still yet a further object of the present invention is to provide a new and improved reciprocating barrel firearm apparatus which has a length which is only minimally longer than the length of the barrel.

Still another object of the present invention is to provide a new and improved reciprocating barrel firearm apparatus that employs a barrel that has reciprocating movement caused by released gasses from an ignited propellent to automatically or semi-automatically operate the loading or discharging of a cartridge.

Yet another object of the present invention is to provide a new and improved reciprocating barrel firearm apparatus which enables selection of either semi-automatic or full automatic operation.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
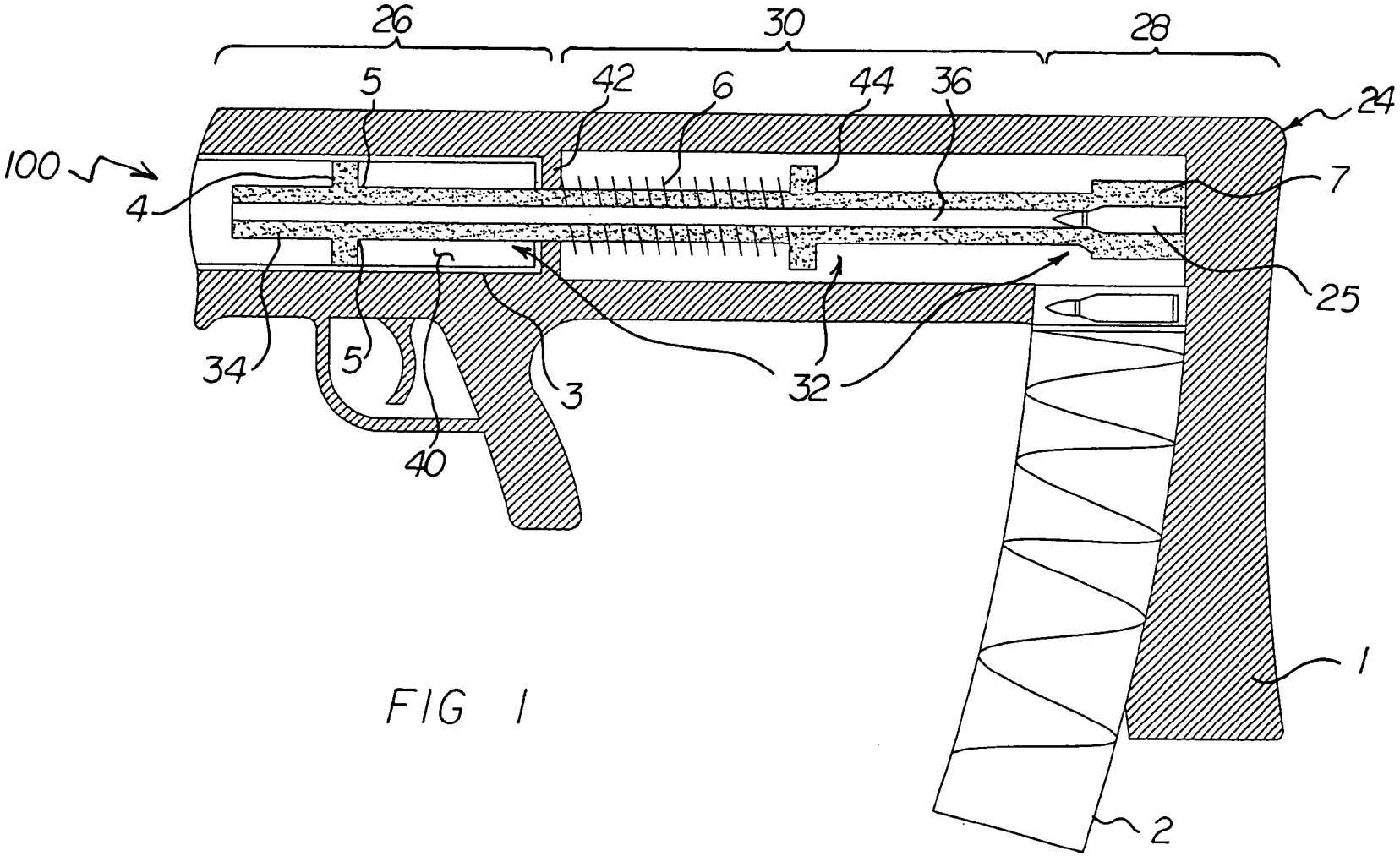
FIG. 1 is a cross-sectional view showing a generalized embodiment of the reciprocating barrel firearm apparatus of the invention showing elements and structures wherein: the barrel moves forward after shooting; an empty cartridge is ejected; and, under the action of the main recoil spring, the barrel returns into the battery, chambering the next cartridge.

With reference to the drawings, a new and improved reciprocating barrel firearm apparatus embodying the principles and concepts of the present invention will be described.

Turning to FIGS. 1, 2, 3, 4, and 5, there is shown a first embodiment of the reciprocating barrel firearm apparatus of the invention generally designated by reference numeral 100. In the first embodiment, reciprocating barrel firearm apparatus 100 includes a gun housing 24 which includes a front gun housing portion 26, a rear gun housing portion 28, and an intermediate gun housing portion 30 located between the rear gun housing portion 26 and the rear gun housing portion 28. The gun housing 24 includes a barrel support channel 42 between the front gun housing portion 26 and the intermediate gun housing portion 30. A barrel 32 is housed inside the gun housing 24. The barrel 32 includes a piston-sleeve-contained barrel portion 34 located substantially in the front gun housing portion 26, an intermediate barrel portion 36 located substantially in the intermediate gun housing portion 30, and a barrel chamber portion 7 located substantially in the rear gun housing portion 28. The piston-sleeve-contained barrel portion 34 includes a barrel piston head 4 and primary first gas ports 5 located behind the barrel piston head 4. A piston sleeve 3 is housed in the front gun housing portion 26 and in front of the barrel support channel 42. The piston sleeve 3 receives the piston-sleeve-contained barrel portion 34, and the barrel piston head 4 is in sliding contact with the piston sleeve 3. Proximal portions of the barrel piston head 4, the piston-sleeve-contained barrel portion 34, and the piston sleeve 3 form a pressure space 40.

A recoil spring retainer portion 44 is connected to the intermediate barrel portion 36 between the barrel support channel 42 and the barrel chamber portion 7. A main recoil spring 6 is located between the barrel support channel 42 and the recoil spring retainer portion 44. A trigger/firing pin mechanism assembly is supported by the gun housing 24 and extends through portions of the front gun housing portion 26, the intermediate gun housing portion 30, and the rear gun housing portion 28.

A cartridge ejection/loading assembly is supported by the rear gun housing portion 28, and a cartridge magazine assembly 2 is supported by the rear gun housing portion 28 and is in communication with the cartridge ejection/loading assembly.

In general, when the reciprocating barrel firearm apparatus 100 of the invention is used, when the trigger/firing pin mechanism assembly is actuated, a cartridge 25 in the barrel chamber portion 7 is fired, and a bullet 58 leaves the cartridge 25 and passes through the intermediate barrel portion 36 and the piston-sleeve-contained barrel portion 34. High pressure gasses follow the bullet 58 as it proceeds through the barrel 32, and the high pressure gasses are contained by the barrel 32 behind the bullet 58. When the high pressure gasses reach the piston-sleeve-contained barrel portion 34, some of the high pressure gasses exit from the piston-sleeve-contained barrel portion 34 through the primary first gas ports 5 into the pressure space 40, allowing pressure to build up in the pressure space 40. As pressure builds up in the pressure space 40, the pressure in the pressure space 40 presses against the rear wall of the barrel piston head 4, causing the barrel piston head 4 to push the barrel 32 forward. As the barrel 32 moves forward, the main recoil spring 6 is compressed between the barrel support channel 42 and the recoil spring retainer portion 44. When the rear wall of the barrel piston head 4 reaches the end of the piston sleeve 3, the high pressure gasses in the pressure space 40 are released into the atmosphere from the pressure space 40. Then, the compressed main recoil spring 6 returns to its unstressed condition, and the cartridge ejection/loading assembly ejects the spent cartridge 25 from the barrel chamber portion 7 and loads a fresh cartridge 25 into the barrel chamber portion 7.

Further details with respect to the structures and operation of a trigger/firing pin mechanism assembly and a cartridge ejection/loading assembly are provided below.

The trigger/firing pin mechanism assembly can include a trigger member 48 supported by the gun housing 24. A trigger-action bar 14 is connected to the trigger member 48. A sear 12 is connected to the trigger-action bar 14. A striker-actuation transfer bar 15 is connected to the trigger-action bar 14. A striker 13 operated by the sear 12, and a firing pin 11 operated by the striker-actuation transfer bar 15.

The cartridge ejection/loading assembly can include an auxiliary gas port 8 located in the piston-sleeve-contained barrel portion 34 for passing high pressure gasses through the barrel 32 to the pressure space 40. A barrel unlocker bar 9 which includes a forward bar portion 50 in the pressure space 40 and an intermediate bar portion 52 is connected to the forward bar portion 50. A lifting/locking member 10 supported by the gun housing 24 and in contact with the intermediate bar portion 52. The lifting/locking member 10 is in contact with the barrel chamber portion 7. A loading/ejector lever 19 is provided for removing a cartridge 25 from the cartridge magazine assembly 2 for loading the cartridge 25 into the barrel chamber portion 7.

More specifically, with respect to operation of the embodiment of the invention shown in FIGS. 2, 3, 4, and 5, the apparatus is configured for semi-automatic operation.

Figure 2:
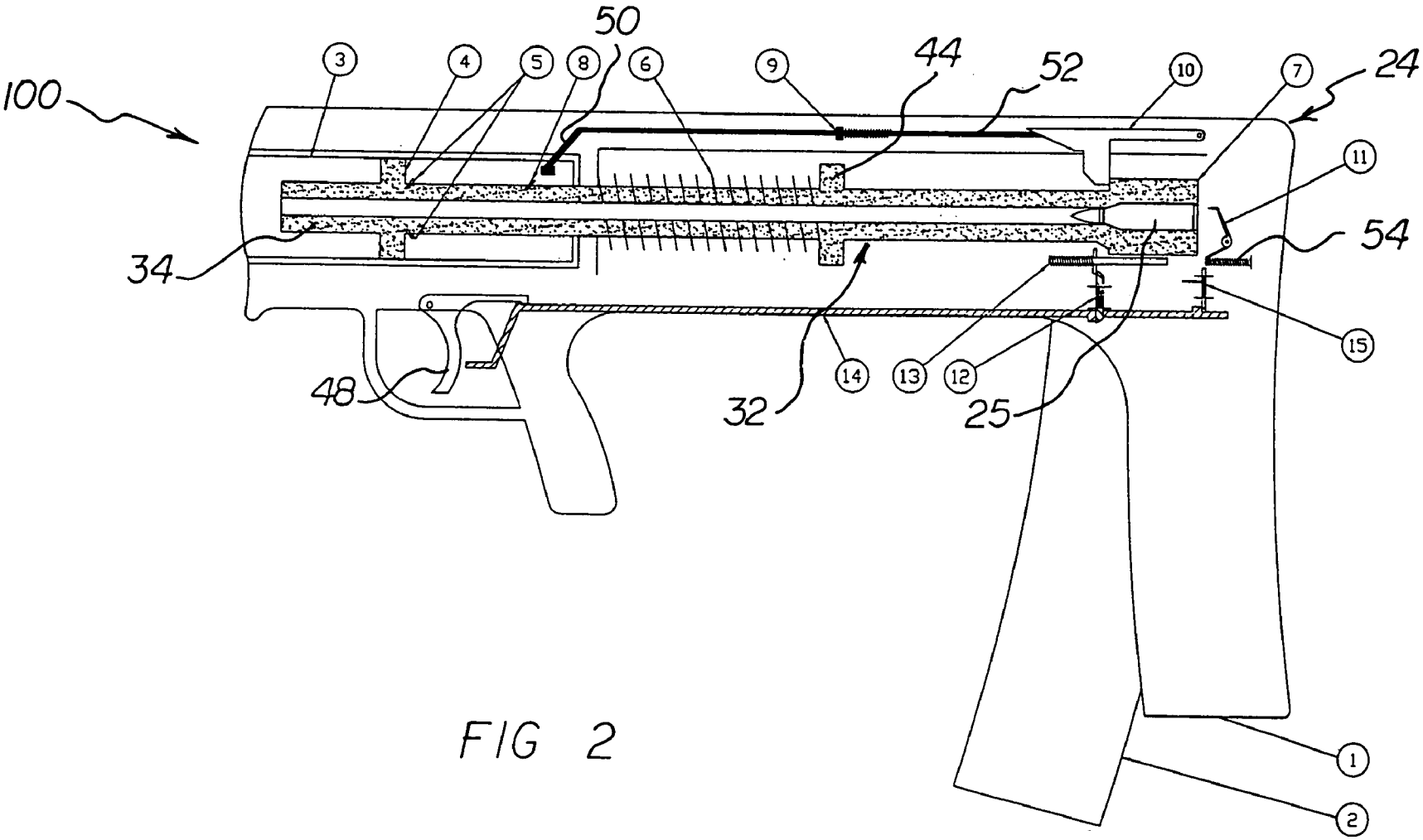
FIG. 2 is a cross-sectional view of a first semi-automatic embodiment of the reciprocating barrel firearm apparatus of the invention, wherein the cartridge is ready to discharge.

FIG. 2 is a cross-sectional view of a first semi-automatic embodiment of the reciprocating barrel firearm apparatus of the invention. The cartridge is ready to discharge. More specifically, as shown in FIG. 2, the apparatus is ready to discharge. The auxiliary gas port 8 serves to unlock the barrel 32 by moving the barrel unlocker bar 9 back, and lifts the lifting/locking member 10. The firing pin 11 pivots in the middle. The mass at both sides of the pivoting point must be the same, so that a heavy blow to the apparatus will not propel the firing pin 11 against the cartridge 25. A small spring 54 acting on the firing pin 11, opposite the striker 13, will always maintain the firing pin 11 in the proper position. The sear 12 operates in a manner so that, as the trigger-action bar 14 moves backward, the trigger-action bar 14 pushes the sear 12 downward (also see FIG. 8A) releasing the striker 13. The striker 13 is not coaxial with the barrel 32. The striker 13 is closer to the barrel axis near the breech, so that the barrel 32, in its forward movement, will initially carry the striker 13, but the striker 13 will disengage from the barrel as the distance between them becomes larger.

As the trigger-action bar 14 moves backward, the trigger-action bar 14 pushes the striker-actuation transfer bar 15 upward (also see FIG. 8A), allowing the striker 13 to reach the firing pin 11. This striker-actuation transfer bar 15 is a safety device. If the trigger member 48 is not pressed and the striker-actuation transfer bar 15 is raised, the striker 13 cannot reach the firing pin 11 (also see FIG. 8 The released striker 13 cannot reach the firing pin 11 without a raised striker-actuation transfer bar 15).

Because of the distance between the trigger member 48 and the firing pin 11 at the back of the apparatus, the trigger-action bar 14 might have enough mass so as to cause an unintentional discharge if the apparatus is hit hard on the butt stock 1. To avoid this problem, and to avoid the use of springs that would cause the trigger mechanism to feel too heavy, the trigger-action bar 14 is locked by the hook portion 56 at the back of the trigger member 48 (see FIG. 8C), and because the hook portion 56 is an integral part of the trigger member 48, the hook portion 56 can release the trigger-action bar 14 only as the trigger member 48 is pressed.

Figure 2A:
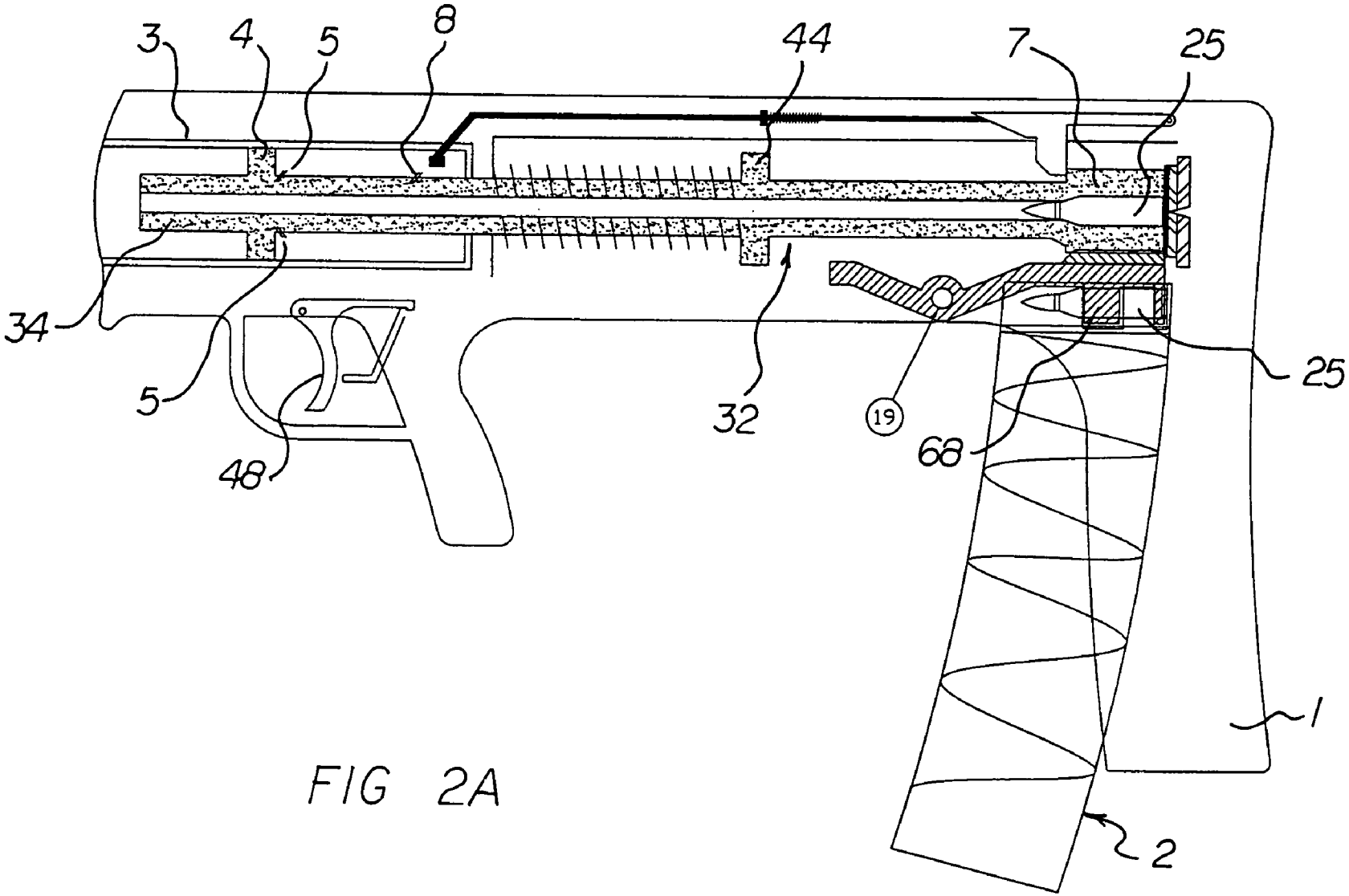
FIG. 2A is a cross-sectional view of a second embodiment of the invention wherein the apparatus is ready to discharge, and the loading mechanism is at rest.

In FIG. 2A, a second embodiment of the invention is shown which is in a semi-automatic mode, and which is ready to fire a cartridge 25, showing a loading mechanism has a loading/ejector lever 19 at rest. A fresh cartridge 25 is in the barrel chamber portion 7. The loading/ejector lever 19 has grasped the next cartridge 25 in the cartridge magazine assembly 2.

Figure 3:
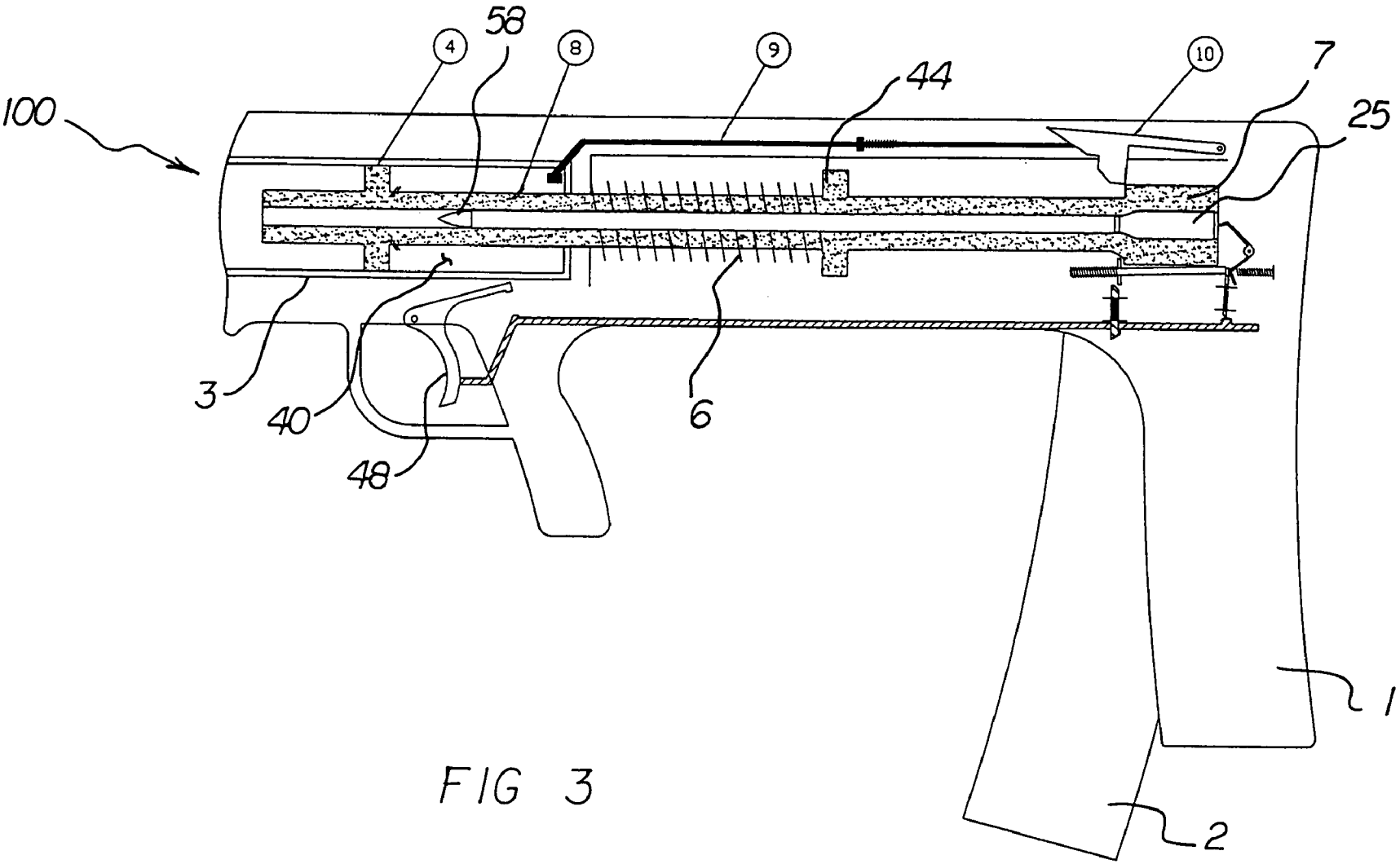
FIG. 3 is a cross-sectional view of the embodiment of the invention shown in FIG. 2 wherein the cartridge has been discharged, but the bullet has not yet exited from the barrel.

FIG. 3 is a cross-sectional view of the embodiment of the invention shown in FIG. 2 The cartridge has been discharged, but the bullet has not yet exited from the barrel. More specifically, in FIG. 3, the bullet 58 from the fired cartridge 25 has passed by the auxiliary gas port 8 but has not yet exited from the barrel 32. The high pressure gasses from the auxiliary gas port 8 have moved back the barrel unlocker bar 9 which has moved the lifting/locking member 10 upward, unlocking the barrel 32. As this occurs, high pressure gasses are in the pressure space 40, behind the barrel piston head 4.

Figure 4:
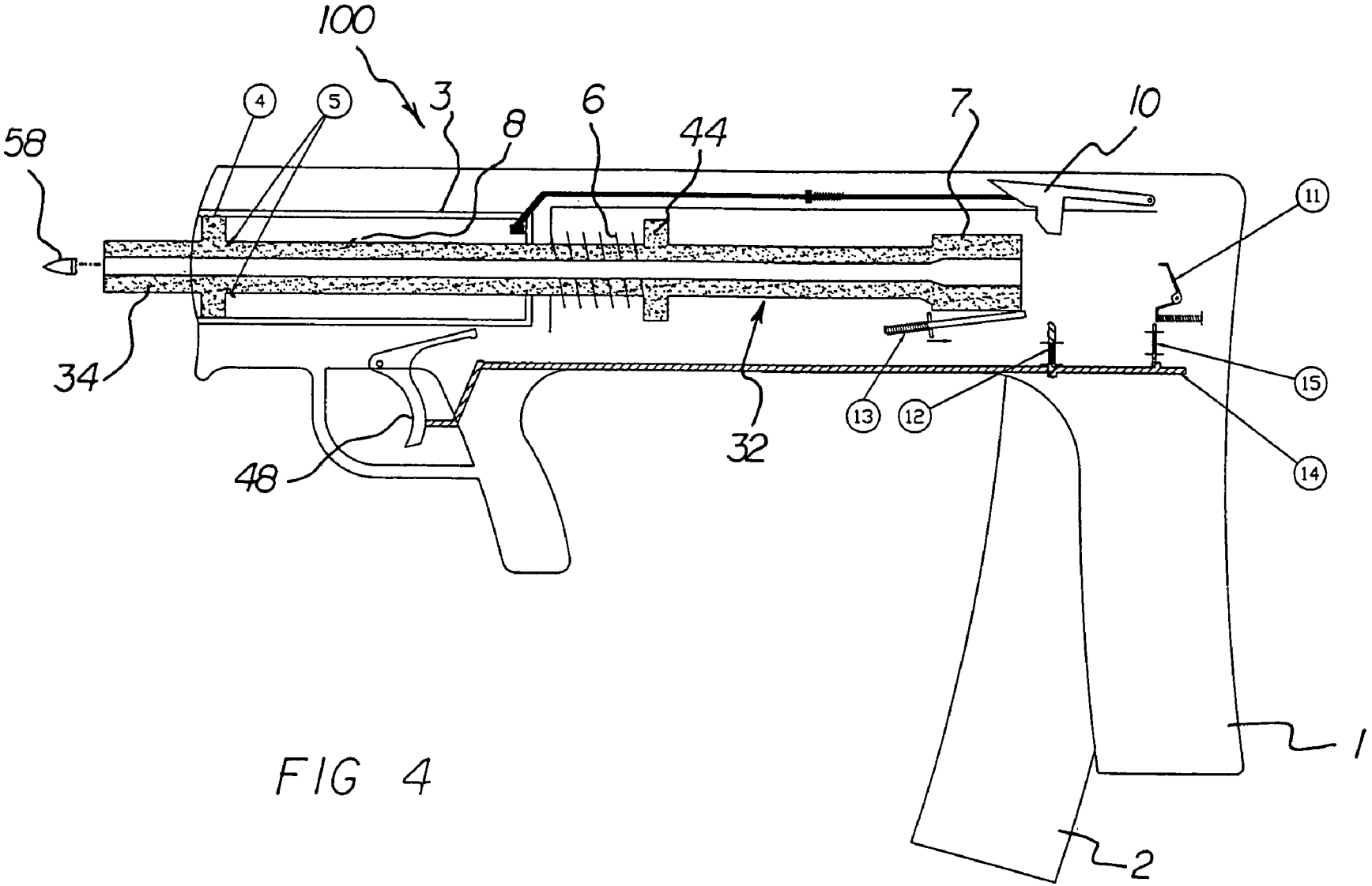
FIG. 4 is a cross-sectional view of the embodiment of the invention shown in FIGS. 2 and 3, wherein the bullet has exited from the barrel.

FIG. 4 is a cross-sectional view of the embodiment of the invention shown in FIGS. 2 and 3. The bullet has exited from the barrel. More specifically, in FIG. 4, the bullet 58 has exited from the piston-sleeve-contained barrel portion 34. When the bullet 58 passes the primary first gas ports 5, the extra pressure in the pressure space 40 behind the barrel piston head 4 moves the unlocked barrel 32 forward. The following actions happen at the same time.

(A) The striker 13 is carried forward. Because the striker 13 is at an angle in relation to the barrel 32, after some travel, it disengages from the barrel chamber portion 7, returns a little bit, and is caught by the sear 12.

(B) The sear 12 and the striker-actuation transfer bar 15 return their original positions. This is accomplished even if the trigger member 48 is not released because the rear most part of the trigger-action bar 14 move horizontally towards the barrel chamber portion 7 when the barrel chamber portion 7 is not in the closed position (see FIG. 8B). This horizontal movement of the trigger-action bar 14 releases the sear 12 and the striker-actuation transfer bar 15.

(C) The firing pin 11 returns to its original position.

Figure 5:
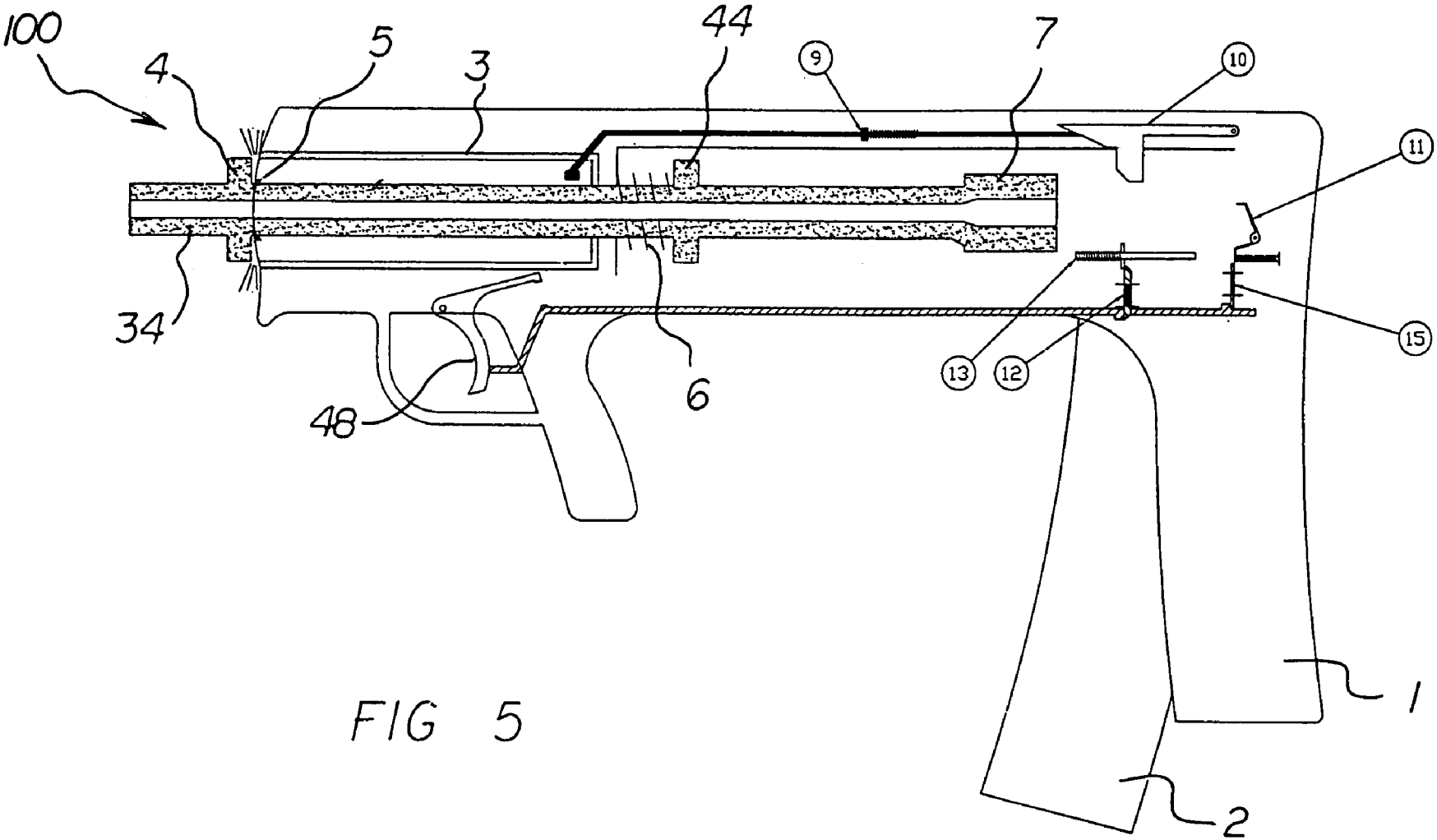
FIG. 5 is a cross-sectional view of the embodiment of the invention shown in FIGS. 2, 3, and 4, wherein the barrel is at the most forward extension.

FIG. 5 is a cross-sectional view of the embodiment of the invention shown in FIGS. 2, 3, and 4. The barrel is at the most forward extension. More specifically, in FIG. 5, for the semi-automatic operation, the barrel 32 is in the most forward position. In the most forward position, the following action happens.

(A) The gasses in the pressure space 40 vent forward into the ambient air. As a result, no gas pressure is behind the barrel piston head 4.

(B) The barrel unlocker bar 9 and the lifting/locking member 10 return to their original positions.

(C) The striker 13 has been released by the barrel 32 and is caught by the sear 12.

(D) The striker-actuation transfer bar 15 and the firing pin 11 are in their original positions.

Figure 5A:
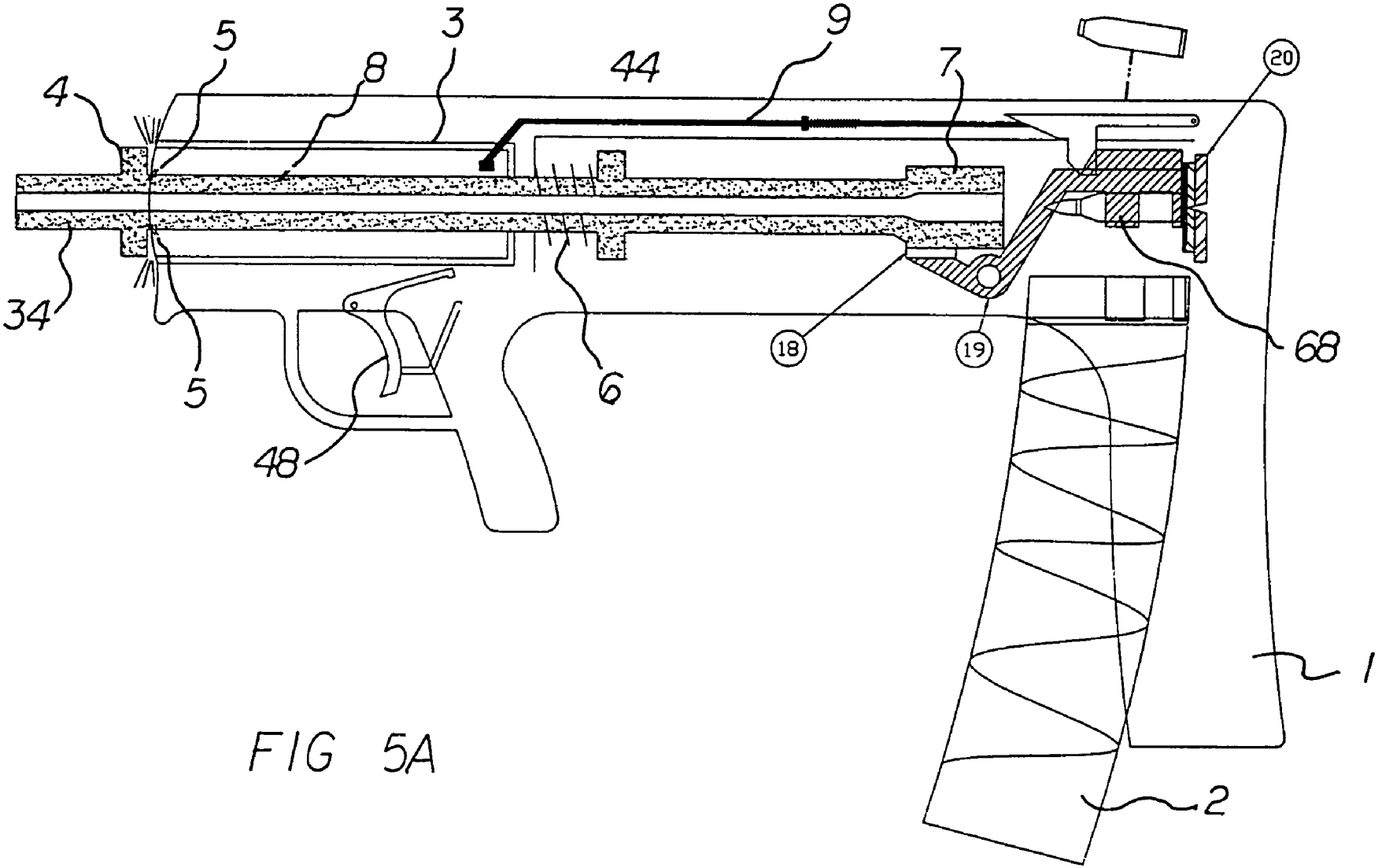
FIG. 5A is a cross-sectional view of the embodiment of the invention shown in FIG. 2A, wherein the barrel is at the most forward extension and wherein the loading mechanism is shown and a live cartridge is being ejected.

In FIG. 5A, a loading mechanism for the semi-automatic version of the apparatus is shown. With the loading mechanism the following actions take place.

(A) The barrel-bottom protrusion 18 pushes down on the forward portion of the loading/ejector lever 19.

(B) The rear portion of the loading/ejector lever 19 is at it's upward most position, and the following actions have been accomplished.

(B-1) The loading/ejector lever 19 has lifted a fresh cartridge 25 from the cartridge magazine assembly 19 and has placed the extractor jaws 20 inside. A fresh cartridge 25 is aligned with the center of the barrel 32.

(B-2) The ejection part of the loading/ejector lever 19 (also see FIG. 7A) has pushed upward on the spent cartridge (the just shot cartridge), releasing its base from the extractor jaws 20. The empty cartridge case flights upward, hitting deflection plate 22 (see FIG. 7A), which is oriented at a deflection angle, deviating the flight of the empty case to the right and through the ejection port.

Figure 6:
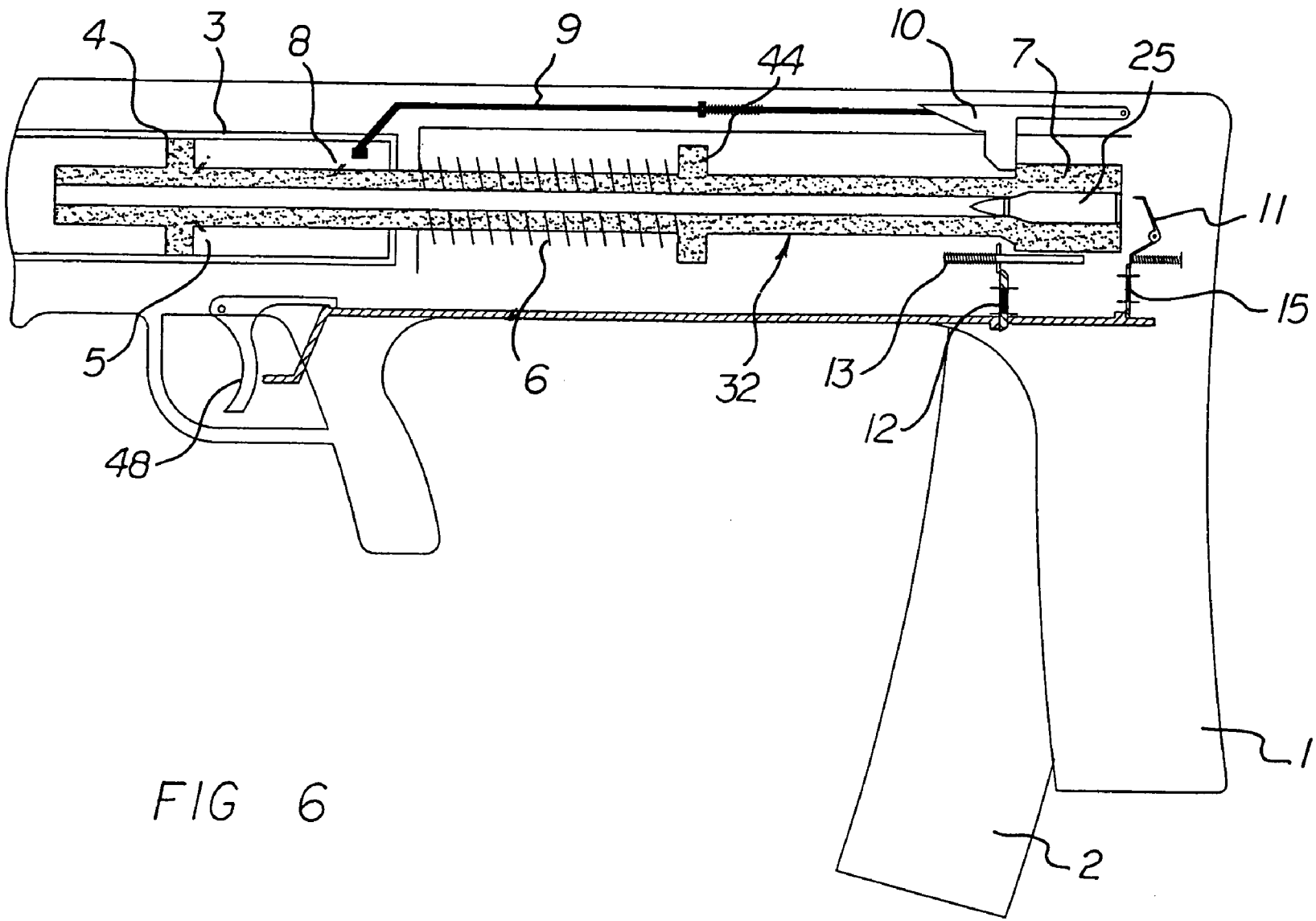
FIG. 6 is a cross-sectional view of the embodiment of the invention shown in FIGS. 2, 3, 4, and 5, (similar to FIG. 2) wherein the apparatus is ready for the next discharge.

FIG. 6 is a cross-sectional view of the embodiment of the invention shown in FIGS. 2, 3, 4, and 5, (similar to FIG. 2) The apparatus is ready for the next discharge. More specifically, in FIG. 6, the semi-automatic operation is ready for the next firing of a cartridge 25.

Figures 6A, 6B:
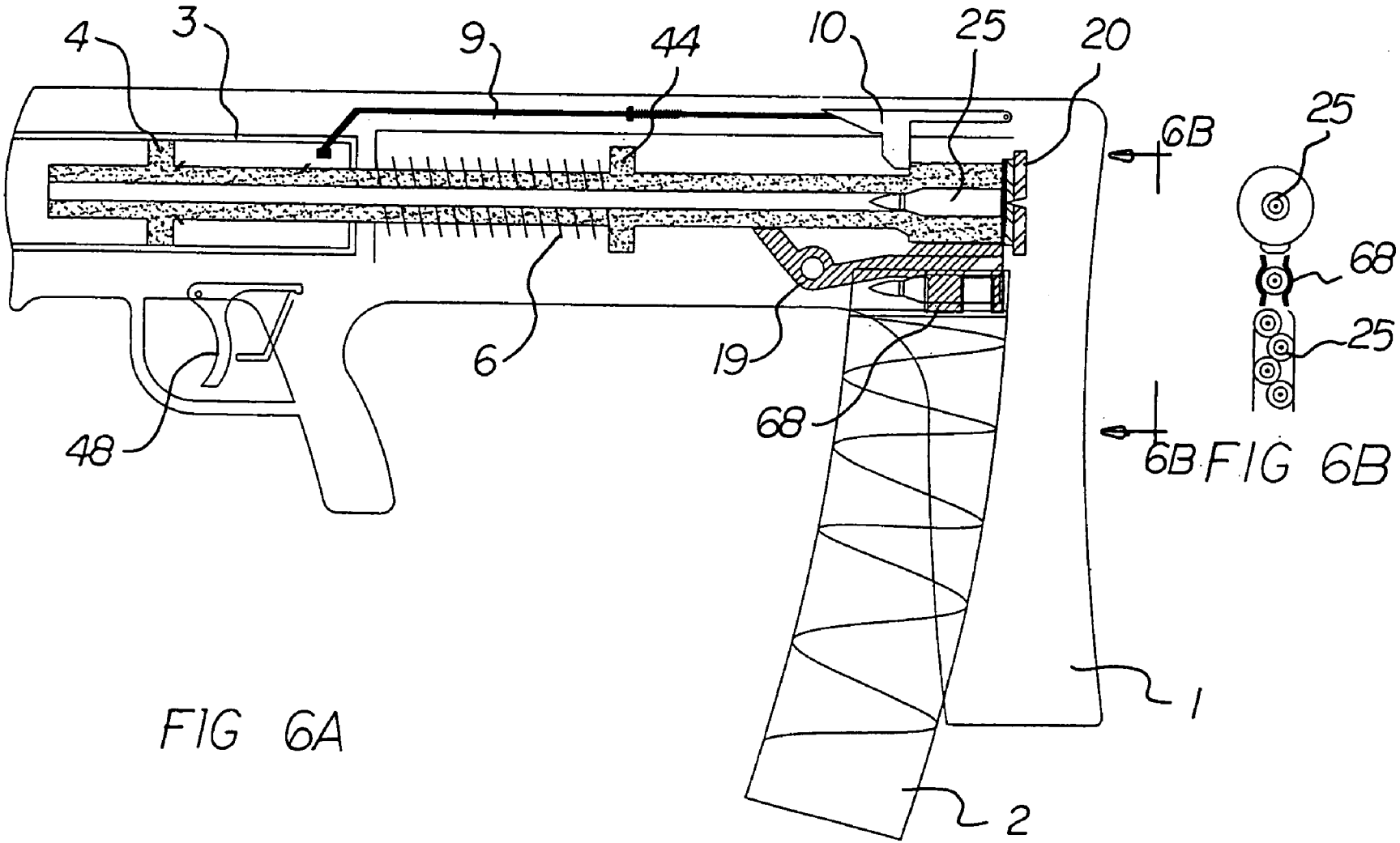
FIG. 6A is a cross-sectional view of the embodiment of the invention shown in FIGS. 2A and 5A, wherein (as similar to FIG. 2A) the apparatus is ready to discharge, and the loading mechanism is at rest.
FIG. 6B is a rear view of a portion of the embodiment of the invention shown in FIG. 6A, taken along line 6B—6B thereof.

FIG. 6A is a cross-sectional view of the embodiment of the invention shown in FIGS. 2A and 5A, wherein (as similar to FIG. 2A) the apparatus is ready to discharge, and the loading mechanism is at rest. More specifically, the barrel 32 has returned to the locked position, and the following steps are taken.

(A) The barrel-bottom protrusion 18 (see FIG. 7), because of its wedge shape and its bevelled edges, while pushing the rear portion of the loading/ejector lever 19 downward, opens the arms 27 of the loading/ejector lever 19 which are wishbone shaped.

(B) This opening of the arms 27 releases the fresh cartridge 25 in the extractor jaws 20. The fresh cartridge 25 is perfectly aligned with the barrel 32, waiting for the barrel 32 to return into battery. The cartridge 25 does not suffer rough handling, allowing the cartridge 25 to includes soft point bullets without is deformed.

(C) The loading/ejector lever 19, with open arms 27, moves downward, grasping a fresh cartridge 25 in the cartridge magazine assembly 2. Because of its bevelled edges of the barrel-bottom protrusion 18, the loading/ejector lever 19 will close its arms 27, securing the fresh cartridge 25.

Figure 7:
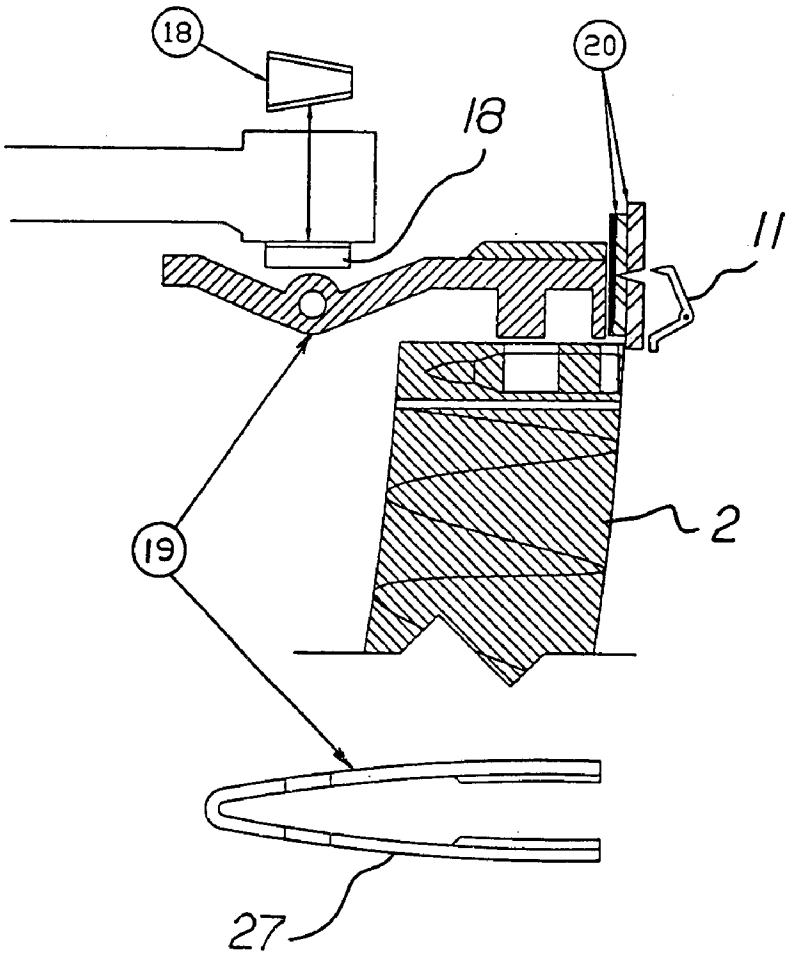
FIG. 7 shows the relation of the barrel, loading/ejector lever, magazine, and extractor jaws.
Figure 7A:
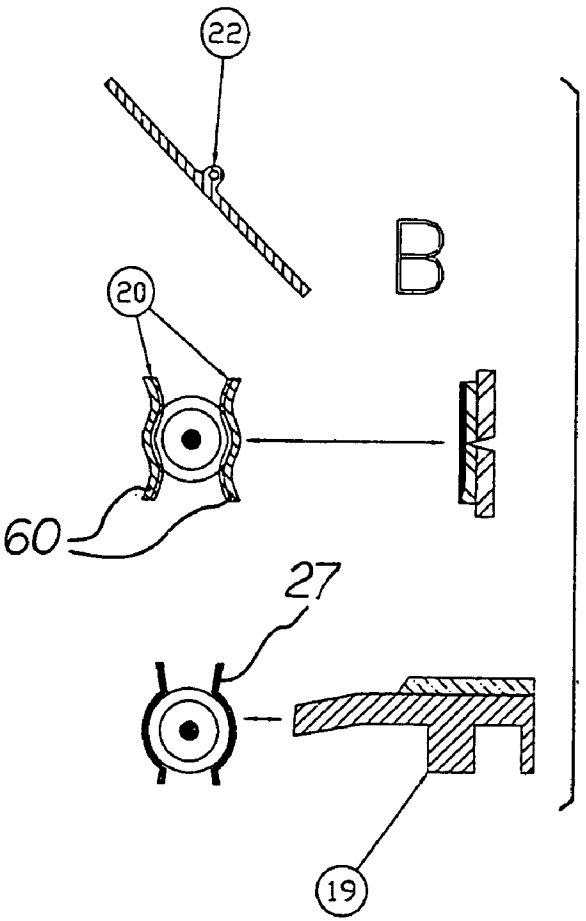
FIG. 7A shows front and side views of: the rearmost portion of arms of the loading/ejector lever, showing the ejection part; extractor jaws; and deflection plate.

FIG. 7 shows the relation of the barrel-bottom protrusion 18, the loading/ejector lever 19, the cartridge magazine assembly 2, and the extractor jaws 20. When the barrel 32 is moving forward, the wider part of the barrel-bottom protrusion 18 pushes down the forward part of the loading/ejector lever 19 (the center part of the wishbone) lifting the rear part of the loading/ejector lever 19 (the arms 27). This action does the following it lifts a fresh cartridge 25 upward, from the cartridge magazine assembly 2, sliding its rim under the extractor jaws 20. The cartridge magazine assembly 2 is of a double column design. The arms 27 of the loading/ejector lever 19 grasp the top cartridge 25, and dislodges it from the cartridge magazine assembly 2 when they are moving up. The arms 27 have some lateral leeway when they are released from the barrel-bottom protrusion 18, allowing them to grasp the cartridge 25 off center, to either side inside the cartridge magazine assembly 2. Also, the ejection part of the loading/ejector lever 19 (as shown in FIG. 7A) pushes the empty (just shot) cartridge case upward, releasing its base from the extractor jaws 20. The empty case flights upward, hitting the deflection plate 22 (as shown in FIG. 7A).

When the barrel 32 moves back into the battery, the narrow part of the barrel-bottom protrusion 18 (wedge shaped, and side walls of wedge at an angle) opens the arms 27 of the loading/ejector lever 19, pushes down the open arms 27 of the loading/ejector lever 19 with a wider distance between the arms 27 than a cartridge width, and, when the arms 27 slide out of the angled side of the wedge shaped protrusion, the arms 27 close, aligning themselves in a natural way with the topmost cartridge in the cartridge magazine assembly 2.

FIG. 7A shows front and side views of the rearmost portion of arms 27 of the loading/ejector lever 19, showing the ejection part, extractor jaws 20, and deflection plate 22. More specifically, the rearmost portion of the arms 27 of the loading/ejector lever 19 show the ejection parts. These ejection parts are the ones that push the empty cartridge case upward, disengaging it from the extractor jaws.

The wavy cross-section 60 of the extractor jaws 20 helps to center the cartridge 25 waiting for the barrel 32 to come back into the battery. The deflection plate 22 can be pivoted to either side, deflecting the ejected cartridge case to either the right or the left, providing an ambidextrous rifle or sub-machine gun. A control for the deflection plate 22 can be located on the butt stock 1.

Figures 8, 8A, 8B, 8C, 8D:
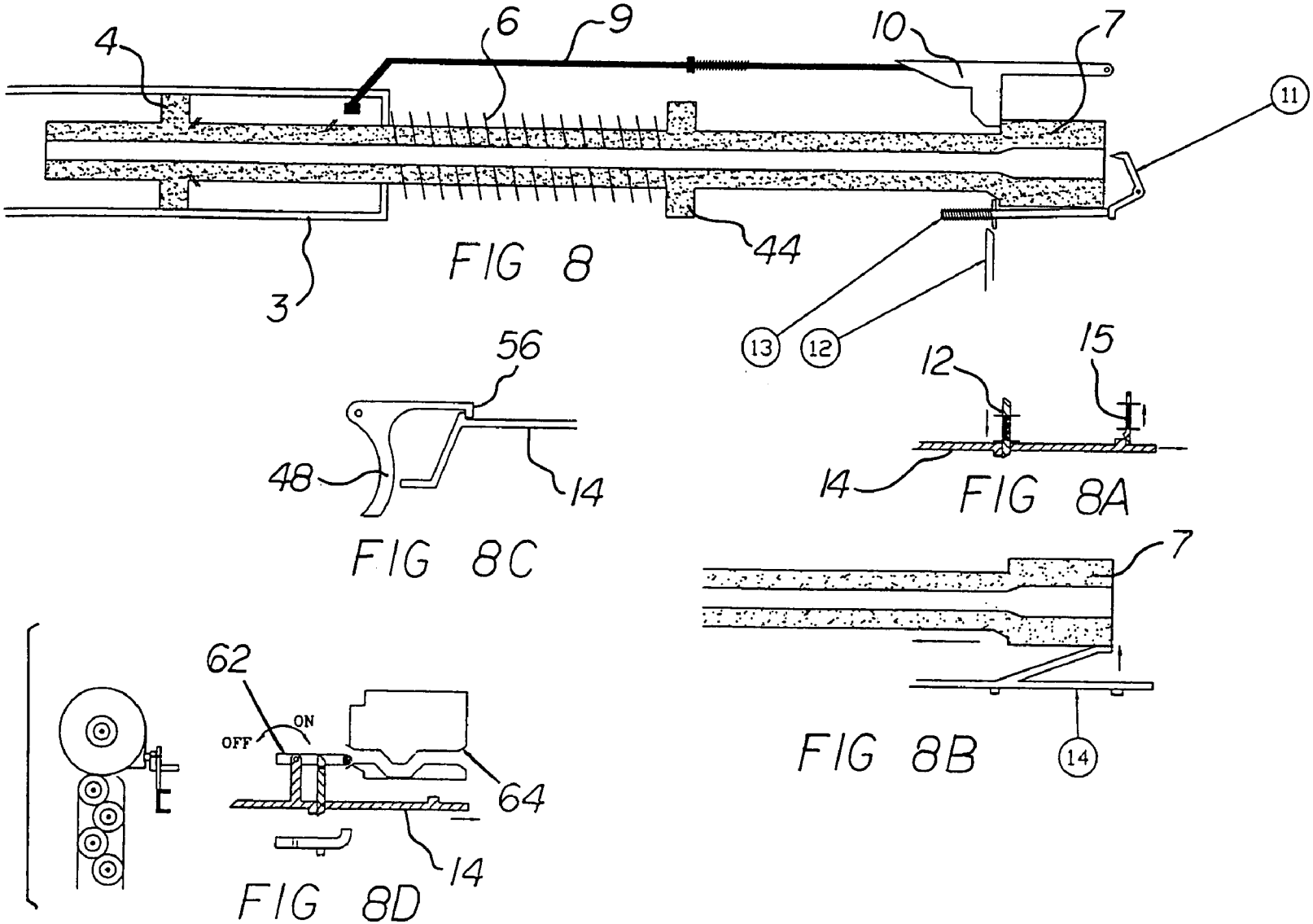
FIG. 8 shows that without the raised striker-actuation transfer bar, the striker cannot reach the firing pin.
FIG. 8A shows that for semi-automatic firing, when the trigger-action bar moves back (the trigger is pulled back), the sear moves down, releasing the striker, and the striker-actuation transfer bar moves up, allowing the striker to contact the firing pin.
FIG. 8B provides an upper view of the trigger-action bar and shows that when the barrel moves forward, the trigger-action bar moves toward the center.
FIG. 8C provides a view of the hook on the trigger, immobilizing the trigger-action bar unless the trigger is pressed.
FIG. 8D provides a view of a portion of a third embodiment of the invention in which a full automatic mechanism is provided.

FIG. 8 shows that without the raised striker-actuation transfer bar 15, the striker 13 cannot reach the firing pin 11.

FIG. 8A shows that for semi-automatic firing, when the trigger-action bar 14 moves back (the trigger member 48 is pulled back), the sear 12 moves down, releasing the striker 13, and the striker-actuation transfer bar 15 moves up, allowing the striker 13 to contact the firing pin 11.

FIG. 8B provides an upper view of the trigger-action bar 14 and shows that when the barrel 32 moves forward, the trigger-action bar 14 moves toward the center of the gun housing 24. This releases the sear 12 and the striker-actuation transfer bar 15, forcing to release and pull the trigger member 48 in order to engage the sear 12 and striker-actuation transfer bar 15 again, enabling a subsequent discharge of a cartridge 25.

FIG. 8C provides a view of the hook portion 56 on the trigger member 48, immobilizing the trigger-action bar 14 unless the trigger member 48 is pressed.

FIG. 8D provides a view of a portion of a third embodiment of the invention in which a full automatic mechanism is provided. There is a full auto bar 62 which is attached to a vertical extension of the trigger-action bar 14. In the semi-automatic mode, the full auto bar 62 is in the vertical position, performing no function whatsoever.

However, with the full automatic mode, the external control (combined safe/semi-automatic/full-automatic control) is rotated from the semi-automatic to the full automatic position. When this is done, the full auto bar 62 is rotated to the horizontal position. The full auto bar 62 blocks horizontal movement of the trigger-action bar 14 so that the striker-actuation transfer bar 15 is raised for as long as the trigger member 48 is pulled.

For the first shot in the full automatic mode, when the trigger member 48 is pulled, the trigger-action bar 14 moves back. The full auto bar 62 bend engages the external groove 64 on the barrel 32, thereby pushing the full auto bar 62 downward. The full auto bar 62 lip depresses the sear 12. The striker 13 is released, hitting the firing pin 11 through the striker-actuation transfer bar 15. The timing of the full auto bar 62 depressing the sear 12 should be ahead of the timing for the semi-automatic action depressing the sear 12, thus bypassing the semi-automatic action.

For subsequent shots in the full automatic mode, with the first shot, the barrel 32 moves forward and then back onto the battery. When the barrel 32 is locking back into the battery, the external groove 64 on the barrel 32 pushes down the full auto bar 62 bend, releasing the following shot. This cycle will continue until either the trigger is released, or the cartridge magazine assembly 2 runs out of cartridges 25.

When the full automatic action is going on, and the trigger member 48 is released, even when the barrel 32 is coming back into the battery and the external groove 64 on the outside of the barrel 32 pushes the full auto bar 62 downward, the full auto bar 62 lip is out of alignment with the sear 12, thus stopping the full automatic cycle.

Turning to FIGS. 9A–9F, illustrations are provided which depict a fourth embodiment which includes means for manually loading a first cartridge 25 and manually ejecting an unfired cartridge 25. These functions are accomplished by an external non-reciprocating load/unload lever 23. With this embodiment, in order to open the breech (to move the barrel 32 forward), the non-reciprocating load/unload lever 23 is pushed forward, not pulled backward as is done conventionally. The load/unload lever 23 is "non-reciprocating", which means that the load/unload lever 23 does not move when the firearm fires in either the semi-automatic of the full automatic mode. That is, when the barrel 32 moves forward and backward during the firing cycle, there is nothing that engages the load/unload lever 23 and its lever spring 66 from a manually set condition.

Figure 9A:
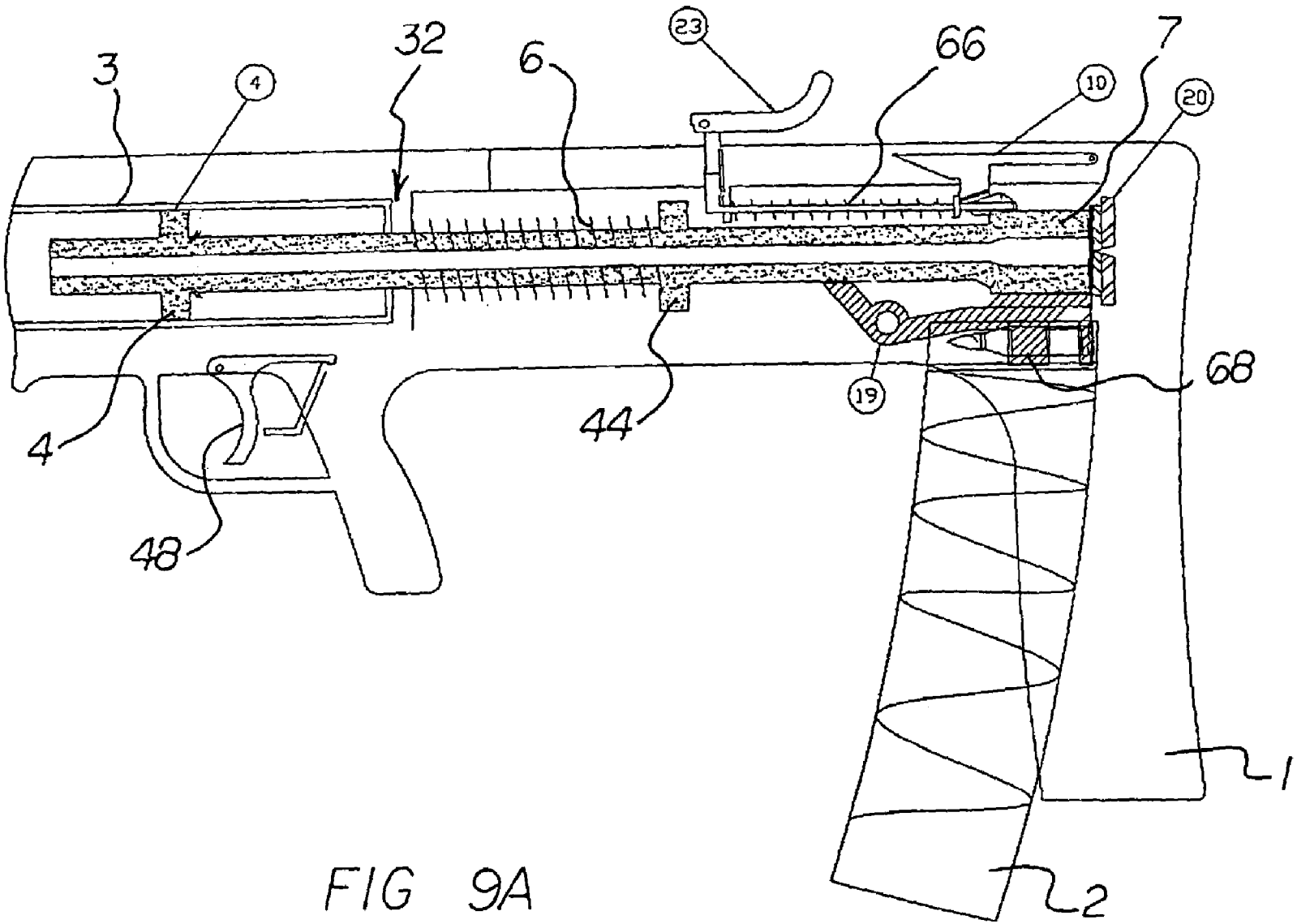
FIG. 9A is a cross-sectional view of a fourth embodiment of the invention in which a load/unload lever is provided and wherein the load/unload lever, the barrel, and the loading/ejector lever are at rest, and wherein the chamber is empty (no cartridge in the chamber), and a fresh cartridge is in the magazine.

More specifically, FIG. 9A is a cross-sectional view of the fourth embodiment of the invention in which a non-reciprocating load/unload lever 23 is provided and The non-reciprocating load/unload lever 23, the barrel 32, and the loading/ejector lever 19 are at rest, and the barrel chamber portion 7 is empty (no cartridge in the chamber), and a fresh cartridge 25 is in the cartridge magazine assembly 2.

Figure 9B:
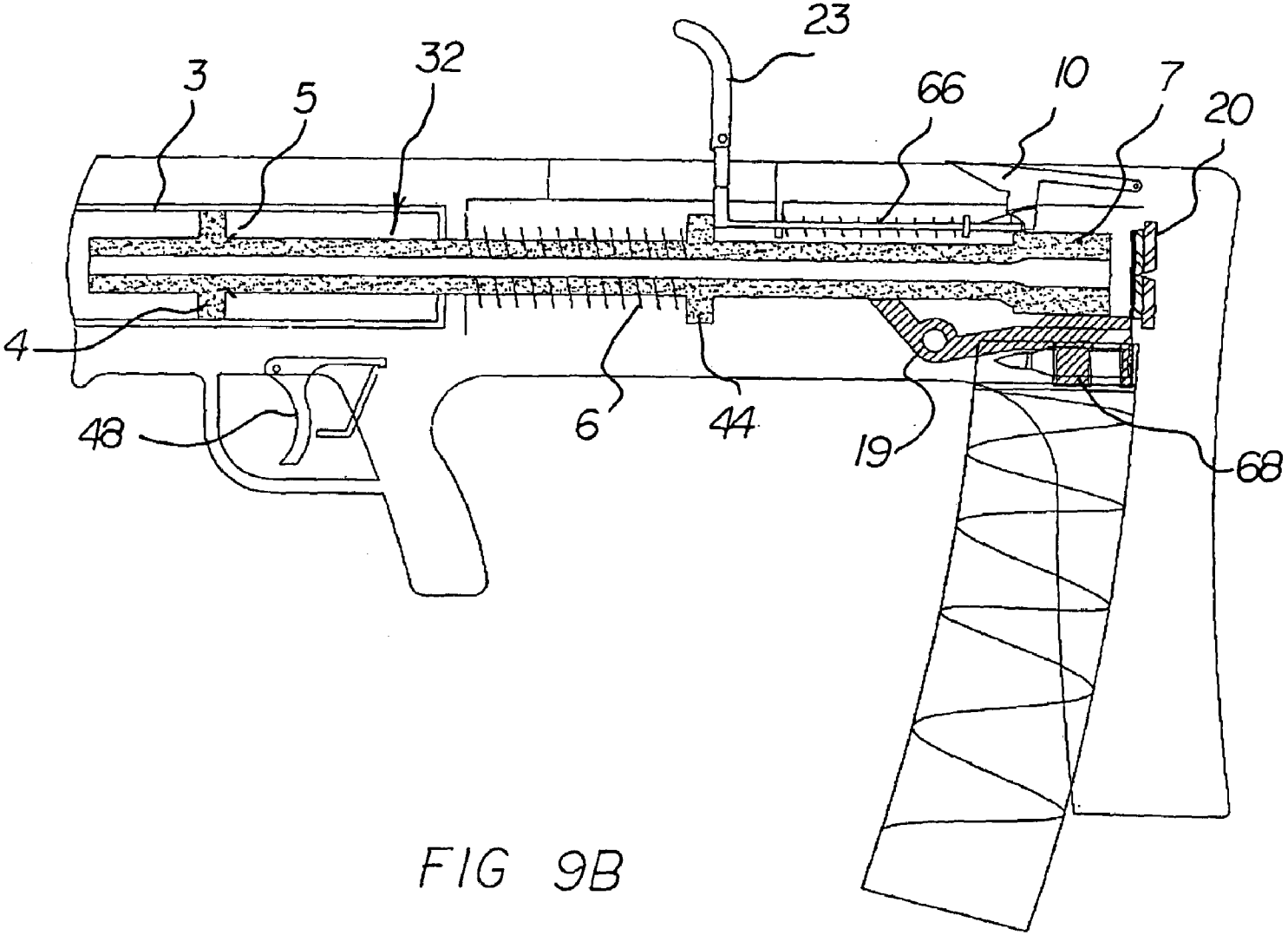
FIG. 9B is a cross-sectional view of the embodiment of the invention shown in FIG. 9A, wherein the ear of the load/unload lever has been lifted to its vertical position, wherein the load/unload lever has been pushed forward until an inverted "V" shape, which is located at its rearmost part, has lifted the barrel locker member by riding against the inclined ledge protruding at the side of this barrel locker member.

In FIG. 9B, there is a cross-sectional view of the embodiment of the invention shown in FIG. 9A. The ear of the non-reciprocating load/unload lever 23 has been lifted to its vertical position. More specifically, the non-reciprocating load/unload lever 23 has been pushed forward until an inverted "V" shape, which is located at its rearmost part, has lifted the lifting/locking member 10 by riding against the inclined ledge protruding at the side of this lifting/locking member 10. This has released the barrel 32. The front part of the non-reciprocating load/unload lever 23 has not started to push the barrel 32 forward.

Figure 9C:
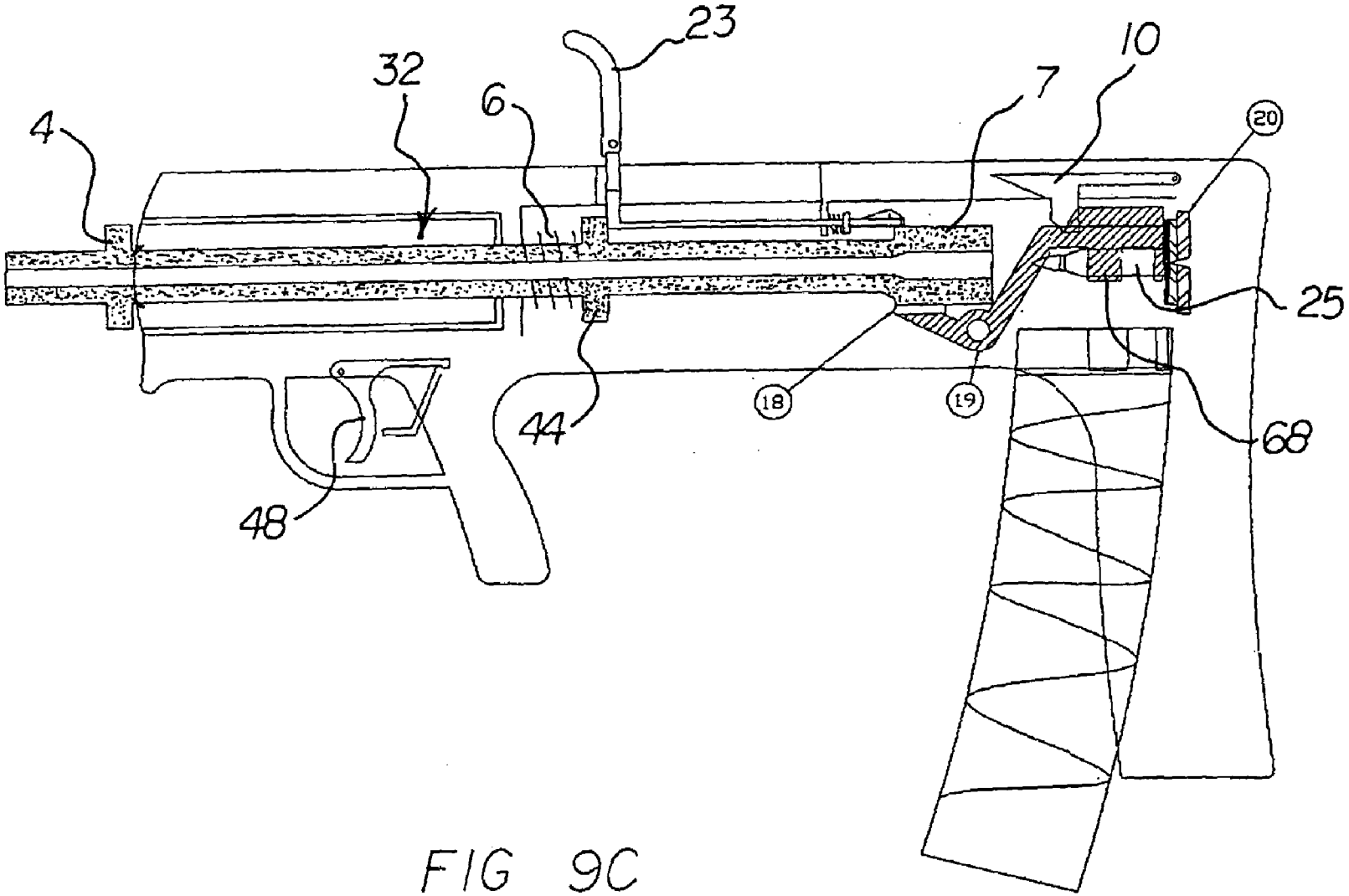
FIG. 9C is a cross-sectional view of the embodiment of the invention shown in FIGS. 9A and 9B wherein the load/unload lever has pushed all the way forward along the barrel, wherein the loading/ejector lever has lifted a fresh cartridge and placed it ready to be chambered.

In FIG. 9C, there is a cross-sectional view of the embodiment of the invention shown in FIGS. 9A and 9B. The non-reciprocating load/unload lever 23 has pushed all the way forward along the barrel 32. The non-reciprocating load/unload lever 23 has lifted a fresh cartridge 25 and placed it ready to be chambered. See above in relation to FIGS. 7 and 7A.

Figure 9D:
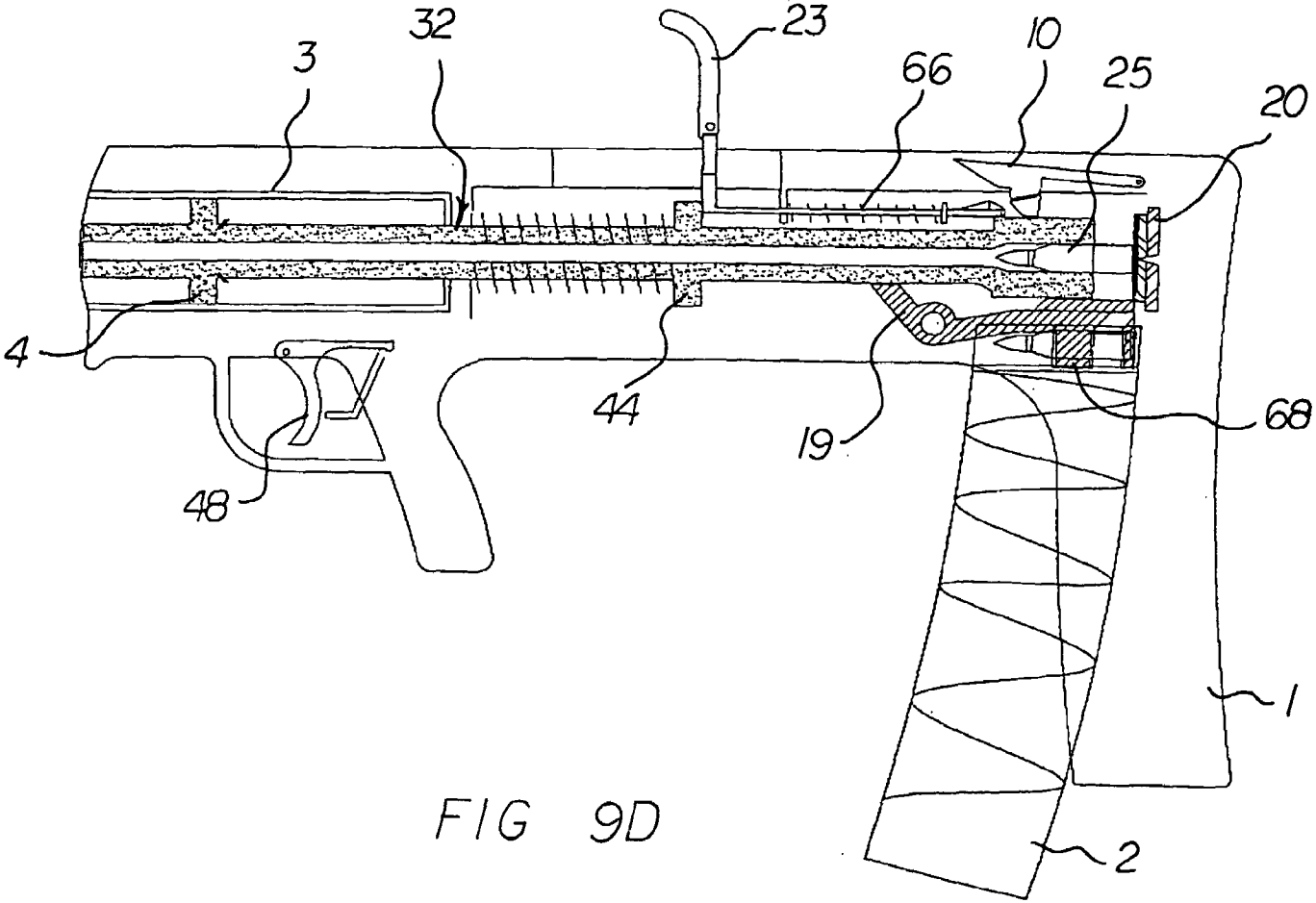
FIG. 9D is a cross-sectional view of the embodiment of the invention shown in FIGS. 9A, 9B, and 9C wherein the load/unload lever has been released, wherein the barrel and the load/unload lever are moving backward under the pressure of their respective springs, and wherein the cartridge is in the process of being chambered.

In FIG. 9D, there is a cross-sectional view of the embodiment of the invention shown in FIGS. 9A, 9B, and 9C The non-reciprocating load/unload lever 23 has been released. The barrel 32 and the non-reciprocating load/unload lever 23 are moving backward under the pressure of their respective springs, and the cartridge 25 is in the process of being chambered. The locking piece 68 of the loading/ejector lever 19 has been lifted by the rear most part of the barrel 32, and will be lifted more when the inverted "V" shape at the rearmost part of the non-reciprocating load/unload lever 23 pushes upward the inclined ledge protruding at the side of the locking piece 68 of the loading/ejector lever 19.

Figure 9E:
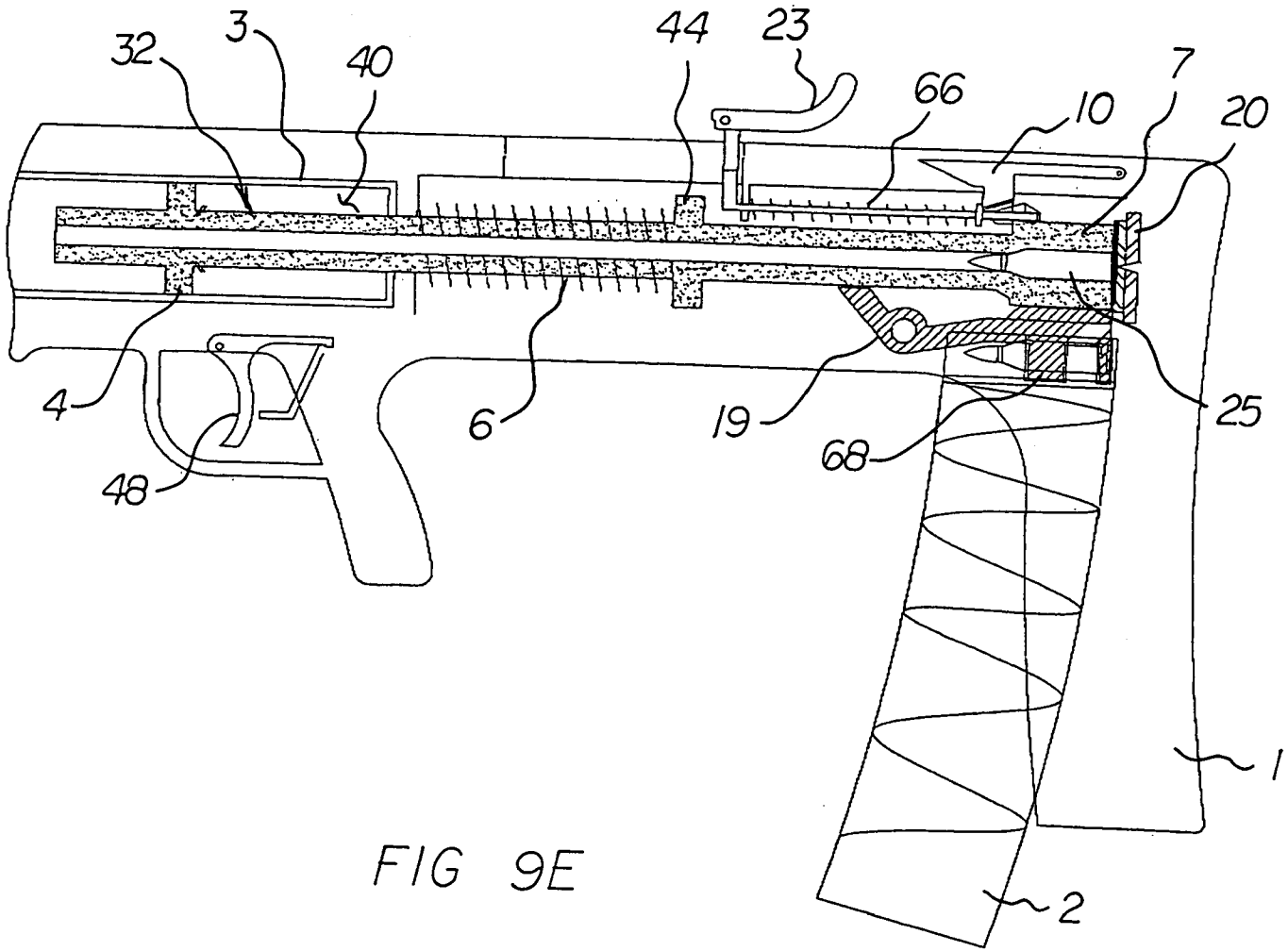
FIG. 9E is a cross-sectional view of the embodiment of the invention shown in FIGS. 9A, 9B, 9C, and 9D wherein all components have returned to the rest position, and wherein this view is the same as FIG. 9A.

In FIG. 9E, there is a cross-sectional view of the embodiment of the invention shown in FIGS. 9A, 9B, 9C, and 9D wherein all components have returned to the rest position, and wherein this view is the same as FIG. 9A, except that now there is a cartridge 25 in the barrel chamber portion 7, and the locking piece 68 on the loading/ejector lever 19 has grabbed the next cartridge 25. The firearm is now ready to be fired.

Figure 9F:
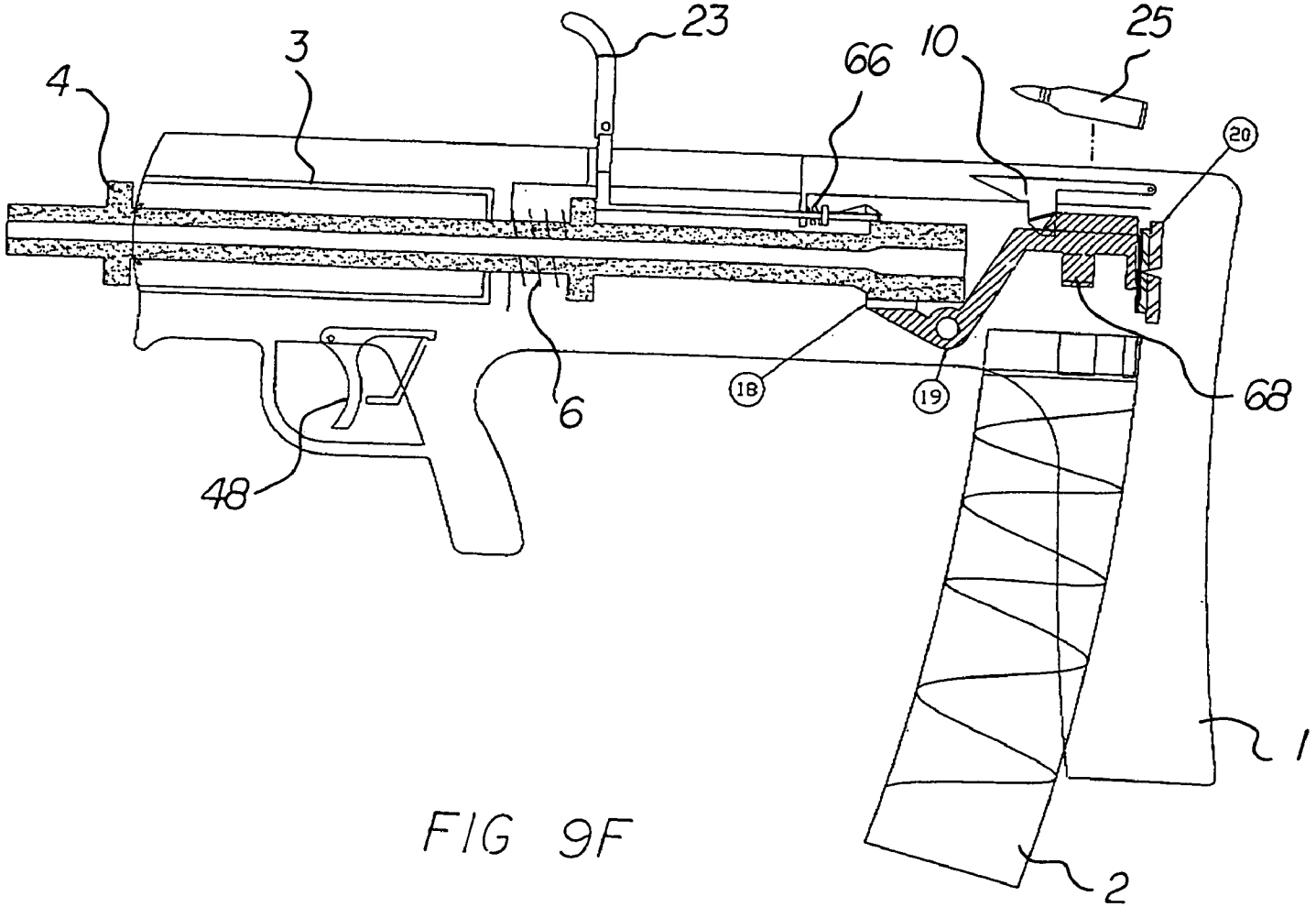
FIG. 9F is a cross-sectional view of the embodiment of the invention shown in FIGS. 9A, 9B, 9C, 9D, and 9E wherein a live cartridge is being ejected from the apparatus in a manner similar to that depicted in FIG. 5A above.

In FIG. 9F, there is a cross-sectional view of the embodiment of the invention shown in FIGS. 9A, 9B, 9C, 9D, and 9E wherein a live cartridge 25 is ejected from the apparatus in a manner similar to that depicted in FIG. 5A above.

To extract a live cartridge 25 from the barrel chamber portion 7, the cartridge magazine assembly 2 is removed from the firearm. Then, the firearm is manually cycled as explained above to eject the live cartridge 25 from the barrel chamber portion 7. Since the cartridge magazine assembly 2 has been removed from the firearm. A fresh cartridge 25 will not be loaded into the barrel chamber portion 7.

The components of the reciprocating barrel firearm apparatus of the invention can be made from inexpensive and durable metal, plastic, wood, and composite materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved reciprocating barrel firearm apparatus that is low in cost, relatively simple in design and operation, and which may advantageously be used to have a length which is only minimally longer than the length of the barrel. With the invention, a reciprocating barrel firearm apparatus is provided which employs a barrel that has reciprocating movement caused by released gasses from an ignited propellent to automatically or semi-automatically operate the loading or discharging of a cartridge. With the invention, a reciprocating barrel firearm apparatus is provided which enables selection of either semi-automatic or full automatic operation.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A firearm apparatus, comprising:

a gun housing which includes a front gun housing portion, a rear gun housing portion, and an intermediate gun housing portion located between said rear gun housing portion and said rear gun housing portion, and wherein said gun housing includes a barrel support channel between said front gun housing portion and said intermediate gun housing portion, a reciprocating barrel housed inside said gun housing, wherein said barrel includes a piston-sleeve-contained barrel portion located substantially in said front gun housing portion, an intermediate barrel portion located substantially in said intermediate gun housing portion, and a barrel chamber portion located substantially in said rear gun housing portion, wherein said piston-sleeve-contained barrel portion includes a barrel piston head and primary first gas ports located behind said barrel piston head, a piston sleeve housed in said front gun housing portion and in front of said barrel support channel, wherein said piston sleeve receives said piston-sleeve-contained barrel portion, and wherein said barrel piston head is in sliding contact with said piston sleeve, wherein proximal portions of said barrel piston head, said piston-sleeve-contained barrel portion, and said piston sleeve form a pressure space, a recoil spring retainer portion connected to said intermediate barrel portion between said barrel support channel and said barrel chamber portion, a main recoil spring located between said barrel support channel and said recoil spring retainer portion, a trigger/firing pin mechanism assembly supported by said gun housing and extending through portions of said front gun housing portion, said intermediate gun housing portion, and said rear gun housing portion, a cartridge ejection/loading assembly supported by said rear gun housing portion, and a cartridge magazine assembly supported by said rear gun housing portion and in communication with said cartridge ejection/loading assembly.

2. The apparatus of claim 1 wherein said trigger/firing pin mechanism assembly includes:

a trigger member supported by said gun housing, a trigger-action bar connected to said trigger member, a sear connected to said trigger-action bar, a striker-actuation transfer bar connected to said trigger-action bar, a striker operated by said sear, and a firing pin operated by said striker-actuation transfer bar.

3. The apparatus of claim 1 wherein said cartridge ejection/loading assembly includes:

an auxiliary gas port located in said piston-sleeve-contained barrel portion for passing high pressure gasses through said barrel to said pressure space, a barrel unlocker bar which includes a forward bar portion in said pressure space and an intermediate bar portion connected to said forward bar portion, a lifting/locking member supported by said gun housing and in contact with said intermediate bar portion, wherein said lifting/locking member is in contact with said barrel chamber portion.

4. The apparatus of claim 1, further including:

a loading/ejector lever for removing a cartridge from said cartridge magazine assembly for loading the cartridge into the barrel chamber portion.

* * * * *